United States Patent [19]

Zinsmeyer

[11] Patent Number: 4,611,969

[45] Date of Patent: Sep. 16, 1986

[54] CALIBRATING APPARATUS AND METHOD FOR A MOVABLE DIFFUSER WALL IN A CENTRIFUGAL COMPRESSOR

[75] Inventor: Thomas M. Zinsmeyer, Pennellville, N.Y.

[73] Assignee: Carrier Corporation, Syracuse, N.Y.

[21] Appl. No.: 766,457

[22] Filed: Aug. 19, 1985

[51] Int. Cl.[4] ..... F04D 17/10; F04D 29/46

[52] U.S. Cl. ..... 415/1; 415/14; 415/158; 415/211

[58] Field of Search ..... 415/1, 51, 158, 211, 415/13, 14, 150, 47, 42–43

[56] References Cited

U.S. PATENT DOCUMENTS

| | | | |
|---|---|---|---|
| 3,362,624 | 1/1968 | Endress | 415/1 |
| 3,426,964 | 2/1969 | Silvern | 415/150 X |
| 3,612,710 | 10/1971 | Mount | 415/14 |
| 3,667,860 | 6/1972 | Endress et al. | 415/150 |
| 3,826,586 | 7/1974 | Richards | 415/13 X |
| 3,989,408 | 11/1976 | Jaegtnes | 415/14 |
| 4,133,615 | 1/1979 | Zitelli et al. | 415/43 |
| 4,219,305 | 8/1980 | Mount et al. | 415/13 |
| 4,257,733 | 3/1981 | Bandukwalla et al. | 415/13 |
| 4,339,226 | 7/1982 | Lee | 415/43 |
| 4,384,819 | 5/1983 | Baker | 415/14 |

FOREIGN PATENT DOCUMENTS

| | | | |
|---|---|---|---|
| 615254 | 7/1978 | U.S.S.R. | 415/14 |

*Primary Examiner*—Everette A. Powell, Jr.
*Attorney, Agent, or Firm*—Douglas L. Miller

[57] ABSTRACT

An apparatus and method is provided for initializing and calibrating a microprocessor controlled refrigeration system including a centrifugal compressor having a variable width diffuser section.

12 Claims, 2 Drawing Figures

CALIBRATING APPARATUS AND METHOD FOR A MOVABLE DIFFUSER WALL IN A CENTRIFUGAL COMPRESSOR

BACKGROUND OF THE INVENTION

The present invention relates to a control for a movable diffuser wall in a centrifugal compressor, and more particularly to calibrating the control when the position of the wall in the diffuser is unknown.

Various schemes have been utilized in the past to increase the efficiency of centrifugal compressors, such as using variable speed motors to vary the rotation of the impeller. Another scheme involves the use of vanes, both fixed and adjustable, in the diffuser section of the machine. Yet another scheme towards improving both the efficiency and operating range of a centrifugal compressor is through the use of a variable width vaned diffuser. In this case, the diffuser contains a movable wall that can be selectively positioned in regard to a fixed wall to control the flow of refrigerant therebetween. A centrifugal compressor employing this movable wall feature is disclosed in U.S. Pat. No. 4,527,949, which is assigned to the Assignee of this application. As disclosed in U.S. Pat. No. 4,527,949, the inlet guide vanes of the compressor are used in a conventional manner to regulate the mass flow of refrigerant through the machine while the diffuser wall position is varied to prevent surging.

In U.S. Pat. No. 4,503,684, a correlation has been incorporated into the compressor control to relate inlet guide vane positioning with diffuser wall positioning.

In the latter two cases above, a need has been discovered for calibrating the control apparatus for the diffuser wall when the location or position of the diffuser wall is unknown. This situation can exist whenever a loss of power to the control occurs, such as would occur when the system is turned on and off between seasons, during start up after maintenance, or when no earlier data exists in the control regarding the wall position due to intermittent power supply, or for other reasons.

SUMMARY OF THE INVENTION

It is therefore an object of the present invention to provide an improved centrifugal compressor used in refrigeration systems.

A still further object of the present invention is to provide an apparatus and method for calibrating the diffuser wall control in a centrifugal compressor.

These and other objects of the present invention are obtained by a control apparatus for a centrifugal compressor including a diffuser section having a diffuser wall movable relative to a fixed wall; control means for positioning the diffuser wall in response to an input control signal; measuring means for monitoring predetermined system parameters and providing data output signals in response thereto; and programmable means for receiving the data output and providing a control signal for moving the diffuser wall to an optimum position for the measured system parameters. The programmable means is programmed also with a known reference position in the diffuser section and means are provided for determining when the position of the diffuser wall is unknown and generating a calibration signal to the programmable means. The programmable means moves the diffuser wall to the known reference position in response to the calibration signal, whereby the programmable means is calibrated with a known position of the diffuser wall to permit the wall to be moved accurately to the optimum position.

DESCRIPTION OF A PREFERRED EMBODIMENT

Figure 1:
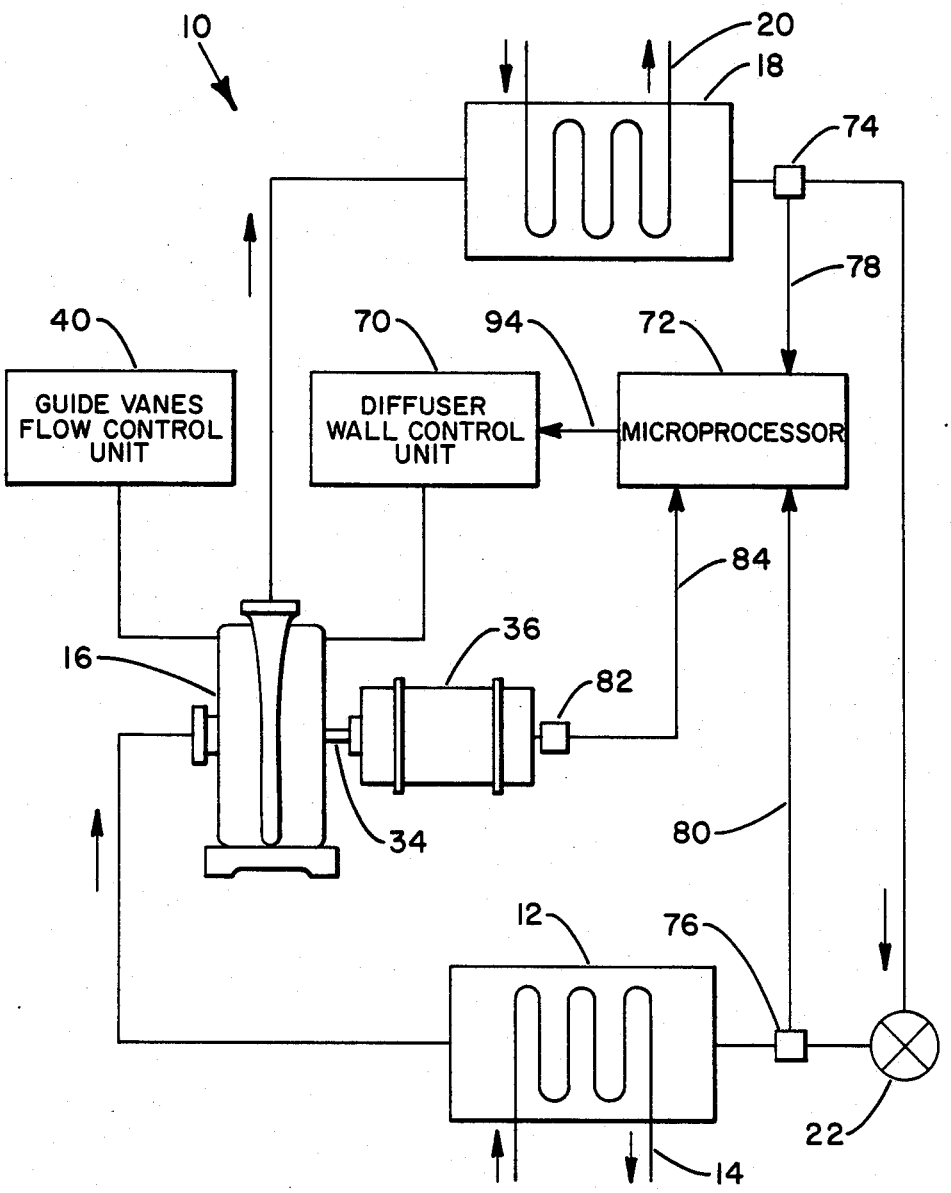
FIG. 1 is a schematic diagram showing a refrigeration system embodying the teachings of the present invention.

Referring to the drawings, there is illustrated a refrigeration system 10 for chilling a liquid within an evaporator 12. The substance to be chilled is circulated through the evaporator 12 via a flow circuit 14 whereupon heat energy from the circulated substance is absorbed by the refrigerant thereby cooling the substance. Refrigerant vapors developed in evaporator 12 are drawn off by means of a centrifugal compressor 16, which serves to pump the refrigerant to a higher temperature and pressure. Slightly superheated vapor leaving compressor 16 is passed through condenser 18 where the superheat and latent heat are removed by cooling water passing through flow circuit 20. The refrigerant leaving condenser 18 is flashed to a lower temperature by means of expansion valve 22 before being passed to the inlet of evaporator 12, thereby completing the refrigeration loop.

Compressor 16 utilizing the present invention is a single-stage machine, however it should be understood that multiple stages may be utilized in the practice of the present invention without departing from the teachings contained herein. Compressor 16 includes an axially aligned inlet 24 that directs incoming refrigerant into a rotating impeller assembly 26 through a series of adjustable inlet guide vanes 28. Refrigerant moving through impeller assembly 26 is turned radially into a diffuser section 30. Diffuser section 30 surrounds impeller assembly 26 and serves to direct refrigerant into a torodial-shaped volute 32. Impeller assembly 26 is rotatably connected to a driveshaft 34 which is coupled to an electrical drive motor 36.

A pulley and cable mechanism 38 uniformly adjusts the position of each guide vane 28 in response to a control signal from flow control unit 40, so as to regulate the flow of refrigerant through compressor 16.

Diffuser section 30 includes a radially disposed stationary wall 42 that forms the back of diffuser passage 44. A movable wall 46 forms the opposite or front part of diffuser passage 44. Movable wall 46 moves axially towards and away from stationary wall 42 to alter the width of diffuser passage 44. By varying the width of diffuser passage 44, the flow of refrigerant through diffuser section 30 can be closely controlled to avoid surging at reduced flow rates, thereby improving the operating efficiency of compressor 16. Furthermore, by continually tracking the lift and flow of compressor 16, it is possible to hold compressor 16 at an optimum operating point close to the surge line without encountering stall.

Movable wall 46 is secured to a generally annular carriage 48 that is slidably contained between shroud 50 and compressor casing 52. Movable wall 46 is secured to carriage 48 in any suitable manner so that both move together towards and away from stationary wall 42. A series of diffuser vanes 54 pass through complementary-shaped openings (not shown) in movable wall 46 and are held in biasing contact against stationary wall 42 by means of springs 56.

Carriage 48 is secured to a double acting piston 58 in any suitable manner. Piston 58 is reciprocatively supported in chamber 60 formed between shroud 50 and casing 52, so that it can be driven axially in either direction. A first flow passage 62 is arranged to bring hydraulic fluid into and out of front section 64 of chamber 60. A second flow passage 66 is arranged to carry hydraulic fluid into and out of rear section 68 of chamber 60. Flow passages 62, 66 are operatively connected with diffuser wall control unit 70. Hydraulic fluid is selectively exchanged between control unit 70 and chamber 60 to drive piston 58 and thus movable wall 46 in a desired direction. A more detailed description of the operation of wall control unit 70 is found in U.S. Pat. No. 4,503,684, which is incorporated by reference herein. The operation of diffuser wall control unit 70 is under the control of microprocessor 72, which is programmed to track various system parameters, such as lift and flow conditions, to continually reposition movable wall 46.

Continuing to refer to FIG. 1, temperature sensors 74, 76 are placed in refrigerant lines leaving condenser 18 and entering evaporator 12, respectively. Saturated temperature information of the refrigerant is continually fed to microprocessor 72 via data lines 78, 80. Similarly, compressor motor 36 is equipped with an ampere monitor 82 that provides amperage information to microprocessor 72 via a third data line 84. This information furnished to microprocessor 72 is used to determine both lift and flow so that the operating point of compressor 16 can be continually controlled.

Figure 2:
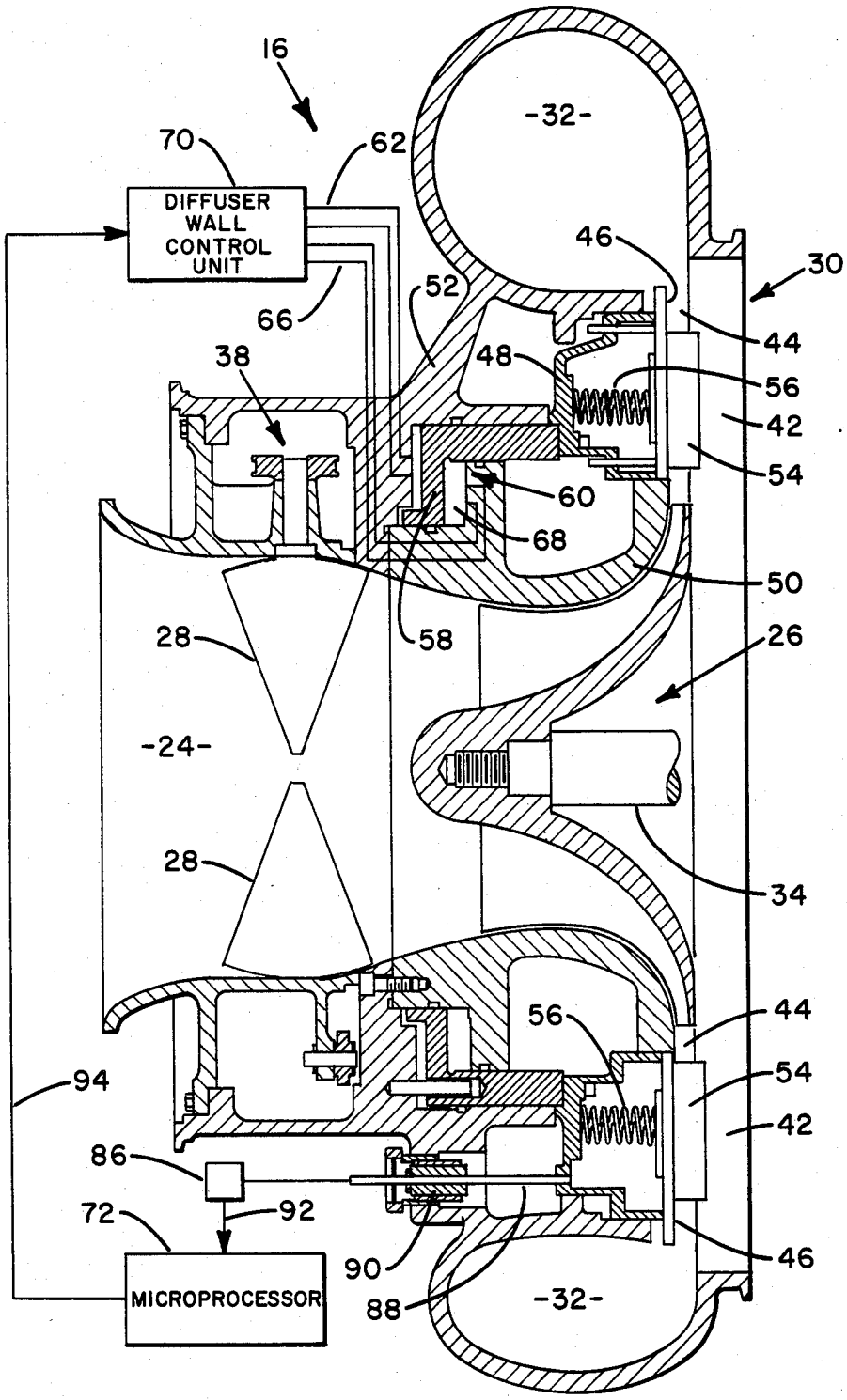
FIG. 2 is a sectional view of a centrifugal compressor employed in the system of FIG. 1.

The position of movable wall 46 is monitored by a potentiometer 86 (FIG. 2). A sensing rod 88 is passed through bellows 90, and rod 88 is secured to carriage 48 so that as carriage 48 moves in and out rod 88 will continually move therewith. Sensing rod 88 is operatively connected to potentiometer 86 to vary the output of potentiometer 86 in accordance with changes in the position of movable wall 46. This data or output of potentiometer 86 is sent to microprocessor 72 via data line 92 to provide microprocessor 72 with exact wall position information. Using this information, the desired width of diffuser passage 44 can be determined for providing optimum efficiency, and wall control unit 70 is instructed via control line 94 to bring movable wall 46 to this particular setting or position. Capacity control is achieved by conventional movable inlet guide vanes 28, while diffuser passage 44 is varied in order to optimize efficiency at reduced flow rates.

To properly position movable wall 46 within diffuser passage 44, microprocessor 72 must be calibrated with a known position of movable wall 46, so that subsequent movements of wall 46 can be accurately attained. Instances when microprocessor 72 will determine when wall 46 is at an unknown or uncalibrated position may occur with loss of power, which would occur between seasons; during any start up; or when no data exists in microprocessor 72 regarding the position of wall 46. Microprocessor 72 can be a Carrier 32 MP type, and may be programmed to calibrate when any of the above situations, or others, occur.

When microprocessor 72 determines that the position of movable wall 46 is unknown or uncalibrated, it will cause movable wall 46 to move to a minimum diffuser width, such as 11% of the full open position, and a two minute delay will occur to insure wall 46 has reached its minimum position. It should be noted that the full open position of a compressor is not necessarily the designed maximum width, but only that selected in accordance with predetermined load requirements. Another method of insuring wall 46 is at its minimum diffuser passage width position is to have microprocessor 72 programmed to take several readings, such as 4 seconds apart, of the position of wall 46, and if the readings are within an acceptable tolerance, then it can be assumed that wall 46 is at its position for minimum diffuser passage width. After initialization, i.e., the moving by microprocessor 72 of wall 46 to a position of minimum diffuser passage width, microprocessor 72 reads the voltage signal provided by potentiometer 86 and uses this reading or voltage signal as a calibrated wall position that is, for example, 11% of maximum design passage width.

After microprocessor 72 has been calibrated, it controls compressor 16 by receiving signals representative of percentage motor current and lift requirements to determine the desired diffuser wall position. Microprocessor 72 then uses the voltage signal from potentiometer 86 to move wall 46 to the desired position. Microprocessor 72 reads the voltage signal of potentiometer 86 as a percentage of wall travel or position in diffuser passage 44, and then can adjust from that known position to move wall 46 to a position for satisfying lift requirements.

The control logic of microprocessor 72 is programmed with a calibration constant which provides a relationship between the change in the resistance, or voltage signal, of potentiometer 86 to the percent change in wall position. This calibration constant and the potentiometer output signal indicative of wall 46 being at its minimum width position, enables microprocessor 72 to calibrate itself, and thus accurately compute desired diffuser wall position.

While this invention has been described as having a preferred embodiment, it will be understood that it is capable of further modifications. This application is therefore intended to cover any variations, uses, or adaptations of the invention following the general principles thereof, and including such departures from the present disclosure as come within known or customary practice in the art to which this invention pertains and fall within the limits of the appended claims.

What is claimed is:

1. In a method of controlling a centrifugal compressor in a refrigeration system that includes the steps of:

providing a diffuser section in the compressor having a movable wall for varying of the width of the diffuser section, measuring predetermined system parameters, defining an optimum position of the movable wall at the measured system parameters, and moving the wall to the optimum position, the improvement comprising the steps of:

providing a programmable device for controlling movement of the wall, determining when the position of the movable wall is unknown, causing the programmable device to move the wall to a known reference position, and calibrating the programmable device with the known position of the wall at the reference position.

2. The method of claim 1 further comprising the step of causing the calibrated programmable device to move the wall to the optimum position.

3. The method of claim 1 wherein the programmable device is a microprocessor.

4. The method of claim 1 wherein the step of determining is performed by the programmable device.

5. A method of calibrating a programmable device programmed to move a diffuser wall member in a diffuser section of a centrifugal compressor, comprising the steps of:

determining when the position of the diffuser wall member is unknown, causing the programmable device to move the diffuser wall member from the unknown position to a known reference position, and calibrating the programmable device with the known position of the diffuser wall member at the reference position.

6. The method of claim 5 wherein the step of determining is performed by the programmable device.

7. The method of claim 5 wherein the programmable device is a microprocessor.

8. In a control apparatus for a centrifugal compressor including:

a diffuser section having a diffuser wall movable relative to a fixed wall for varying the width therebetween, control means for positioning said diffuser wall in response to an input control signal, measuring means for monitoring predetermined system parameters and providing data output signals in response thereto, and programmable means for receiving said data output signals and providing said input control signal for moving said diffuser wall to an optimum position for the measured system parameters, the improvement comprising:

means for determining when the position of said diffuser wall is unknown and generating a calibration signal in response thereto, said calibration signal being transmitted to said programmable means, said programmable means moving said diffuser wall to a known reference position in response to receiving said calibration signal and being calibrated with said diffuser wall at said known reference position, whereby said diffuser wall can be moved accurately to said optimum position.

9. The apparatus of claim 8 wherein said programmable means is a microprocessor.

10. The apparatus of claim 8 wherein said programmable means moves said diffuser wall between a known minimum diffuser width position and a known maximum diffuser width position, said known reference position being one of said diffuser width positions.

11. The method of claim 1 wherein the known reference position is one of a known minimum diffuser width position and a known maximum diffuser width position.

12. The method of claim 5 wherein the programmable device moves the diffuser wall member between a known minimum diffuser width position and a known maximum width position, and wherein the known reference position is one of the known diffuser width postions.

* * * * *